United States Patent [19]

Murase et al.

[11] Patent Number: 4,869,958

[45] Date of Patent: Sep. 26, 1989

[54] POLYESTER FIBER AND PROCESS FOR PRODUCING THE SAME

[75] Inventors: Shigemitsu Murase, Kyoto; Kouji Kakumoto, Kyoti; Shouji Miyazaki, Kyoto; Masaru Sugawa, Kyoto; Mikio Ide, Kyoto, all of Japan

[73] Assignee: Unitika Ltd., Hyogo, Japan

[21] Appl. No.: 26,703

[22] Filed: Mar. 17, 1987

[51] Int. Cl.[4] ..... D02G 3/00

[52] U.S. Cl. ..... 428/364; 528/308.2

[58] Field of Search ..... 428/364; 528/308.2, 528/308.1

[56] References Cited

U.S. PATENT DOCUMENTS

| | | | |
|---|---|---|---|
| 4,134,882 | 1/1979 | Frankfort et al. | 528/308.2 |
| 4,156,071 | 5/1979 | Knox | 528/308.2 |
| 4,390,685 | 6/1983 | Oka et al. | 528/308.1 X |
| 4,415,726 | 11/1983 | Tanji et al. | 264/210.8 X |
| 4,426,516 | 1/1984 | Kuriki et al. | 528/308.2 |
| 4,491,657 | 1/1985 | Saito et al. | 528/308.1 |
| 4,690,866 | 9/1987 | Kumakawa et al. | 528/308.2 |

FOREIGN PATENT DOCUMENTS

| | | |
|---|---|---|
| 45-1932 | 1/1970 | Japan . |
| 53-52721 | 5/1978 | Japan . |
| 53-143728 | 12/1978 | Japan . |
| 53-147814 | 12/1978 | Japan . |
| 55-11767 | 3/1980 | Japan . |
| 56-140117 | 11/1981 | Japan . |
| 57-121613 | 7/1982 | Japan . |
| 57-133216 | 8/1982 | Japan . |
| 59-66507 | 4/1984 | Japan . |
| 59-163414 | 9/1984 | Japan . |
| 60-126318 | 7/1985 | Japan . |
| 60-134019 | 7/1985 | Japan . |

*Primary Examiner*—Lorraine T. Kendell

*Attorney, Agent, or Firm*—Sughrue, Mion, Zinn, Macpeak & Seas

[57] ABSTRACT

A polyester fiber and process embodiments for the production thereof are described, wherein the polyester fiber is produced by high-speed spinning and is characterized by a filament fineness of from 1 to 3 d, a strength of at least 4.0 g/d, an elongation of up to 40%, a crystallinity ($X\rho$) of from 40 to 55%, a birefringence of from $140\times10^{-3}$ to $165\times10^{-3}$, an orientation function of from 0.36 to 0.45 in the amorphous portion, and a thermal shrinking stress that satisfies the relations $$1.1 \leqq ST_{200}/ST_{100} \leqq 2.0 \quad \text{(I)}$$

and $$50 \leqq ST_{max} \leqq 180 \quad \text{(II)},$$

where $ST_{100}$ is the shrinking stress (mg/d) at 100° C., $ST_{200}$ is the shrinking stress (mg/d) at 200° C., and $ST_{max}$ is a peak stress (mg/d) on a thermal shrinking stress curve.

4 Claims, No Drawings

POLYESTER FIBER AND PROCESS FOR PRODUCING THE SAME

FIELD OF THE INVENTION

The present invention relates to a polyester fiber and a process for producing the same. More particularly, the present invention relates to a polyester fiber that is produced by high-speed spinning and which yet possess strength and elongation characteristics that are comparable to those of a drawn fiber produced by the traditional two-step (split) spin-windup-draw process and which has a characteristic amorphous portion that renders the fiber suitable for subsequent processing, in particular for preparation of a hard twist yarn. The present invention also relates to a process for producing such improved polyester fiber.

BACKGROUND OF THE INVENTION

Much research has been undertaken to increase the production rate of synthetic fibers and decrease the production costs by performing high-speed spinning without the necessity of any drawing step. A substantial portion of the reports published in this area is directed to polyester fibers such as polyethylene terephthalate fibers, which are easier to handle than polyamide fibers, because of such advantages as the absence of swelling problems. However, fibers having satisfactory performance are not attainable by simply increasing the spinning speed. The fiber strength increases with increasing spinning speed and reaches a maximum at a speed in the neighborhood of 6,000 m/min but as the spinning speed is increased further, the fiber strength gradually decreases. On the other hand, the fiber elongation decreases with increasing spinning speed, and no fiber is attainable that is fully satisfactory in terms of both strength and elongation. Instead of increasing the spinning speed to as high as 6,000 m/min, U.S. Pat. No. 2,604,667 describes a speed of 5,800 m/min (6,350 Y/-min) in order to make a polyester fiber having a strength of from 3.2 to 4.6 g/d and an elongation of from 38 to 72%. However, this method does not employ a heat treatment during fiber making so that the fiber produced will experience a great variation in thermal shrinking stress under varying temperature conditions that are encountered in heat treatments in subsequent processing. This causes unevenness in the tension being applied to the filament yarn and increases the chance of unevenness of occurring in various aspects of the yarn such as crimp, diameter, and dye absorption.

Two methods have been proposed for producing fibers that satisfy both strength and elongation requirements; according to one proposal, the fiber being subjected to high-speed spinning is treated with steam or dry heat at a stage prior to contact with the take up roller without forcing the fiber to be drawn out between rollers as described, for example, in Japanese Patent Application (OPI) Nos. 140117/81 and 126318/85 (the term "OPI" as used herein means "unexamined published patent application"), and Japanese Patent Publication Nos. 1932/70 and 11767/80; the other method may be described as "super-high speed spinning" which simply consists of winding up the yarn at a speed not lower than 6,000 m/min as described, for example, in Japanese Patent Application (OPI) Nos. 133216/82 and 66507/84.

In the first method, the filaments are subjected to non-contact heating as they travel at high speed under low tension, so they cannot be heated uniformly, and unevenness of yarn is liable to occur. The second method is capable of reducing the fiber elongation as the spinning speed increases, but the strength of the fiber produced is inferior to that of the drawn fiber produced by the two-step spin-windup-draw process.

According to the method of the first category, described in Japanese Patent Publication No. 1932/70, a fiber having an elongation of up to 50% is produced by effecting heat treatment at a temperature of at least 80° C., taking up the spun filaments at 4,000 m/min or faster, and subjecting the filaments to another heat treatment under tension. In this method, the first heat treatment is conducted after the travelling filaments have solidified upon cooling to 80° C. or below, and the filaments are greatly influenced by concomitant flows because of their high travelling speed. As a result, the combined filaments will often fail to be heated uniformly. In addition, the need to effect heat treatment in two stages adds to the production cost.

Japanese Patent Publication No. 11767/80 describes a method for producing a high-strength fiber by heating spun filaments at a stage between cooling and contact with the take up roller. However, in this method a heating tube is situated immediately below the cooling section, so that unevenness of yarn will result because of the difficulty that is involved in maintaining a constant temperature of the heating tube, due to phenomena such as the carry-over of cooling air.

As an alternative to the first and second methods having the aforementioned problems, a process of "coupled spin-drawing" which involves continuous drawing of spun filaments without winding them up may be used to produce a fiber having superior characteristics in terms of not only yarn uniformity but also strength and elongation. Various proposals have been made in order to implement this process, and British Patent No. 1,375,151 describes a method wherein spun filaments that have been taken up at 3,000 m/min or faster are stretched at draw ratios of from 1.3 to 1.8 (i.e., 1.3/1 to 1.8/1) in a heated atmosphere of from 100° to 220° C. However, this method involves high-speed drawing for high draw ratios and the heating employed is indirect rather than direct, so that the temperature distribution of filaments has a tendency to become nonuniform and a fixed draw point cannot be established. Japanese Patent Application (OPI) No. 163414/84 describes a method wherein a fiber having a birefringence of $30\times10^{-3}$ or more is subjected to continuous heat treatment and drawing. This method, however, is not economical since it requires two heating steps.

Japanese Patent Application (OPI) No. 134019/85 discloses a method wherein a fiber that has been drawn at a ratio of up to 3.0 is heat-treated and subsequently wound up at a speed of 4,000 m/min or more. In this method, the fiber is wound around the heating roller by less than one turn in order to ensure threadline stability on the roller but this impairs the uniformity of heat treatment and causes unevenness in various aspects of the yarn such as dyeability. Japanese Patent Application (OPI) No. 143728/78 describes a method wherein undrawn filaments having a crystallinity (Xc) of 30% or more are drawn in the absence of heat at low draw ratios between 1.05 and 1.35. However, crystallization has progressed to a certain extent in the fiber before it is drawn, so that unevenness of yarn may occur if it is subsequently drawn in the absence of heat. Cold drawing has the additional disadvantage that it gives rise to a drawn fiber that is unsatisfactory in both orientation and crystallinity.

The structure of the amorphous portion of a fiber, in particular its orientation, has been reviewed, for example, in Japanese Patent Application (OPI) No. 52721/78 which describes a polyester fiber suitable for processing into woven or knitted fabrics. However, this fiber is extremely low in the density and birefringence and hence is unsatisfactory in strength and elongation. Similar physical properties are specified in Japanese Patent Application (OPI) No. 147814/78; the fiber described in this patent has relaxed orientation in the amorphous portion but is still unsatisfactory in terms of strength (<4.0 g/d) and elongation (≧40%). A description of the physical properties of the amorphous portion is also found in U.S. Pat. No. 4,156,071, but the fiber described in this patent is low in the degree of amorphous structure formation and crystallinity (low density) and hence has low-strength, high-elongation, and low-modulus characteristics. Japanese Patent Application (OPI) No. 121613/82 also includes a description regarding the structure of the amorphous portion, but the fiber proposed has an extremely high degree of crystallinity (Xc) according to an X-ray method and an excessively low shrinking stress, so that the heat settability of the fiber is too low to ensure high efficiency and good results in subsequent processing such as crimping.

As described above, various proposals have been made in order to enable a single step of high-speed spinning to produce a yarn whose quality is comparable to that of drawn fibers. However, the fibers produced by the thus far described methods are defective in one way or another as manifested by insufficient strength and elongation properties, reduced dyeability or high likelihood of unevenness of occurring in yarn on account of thermal shrinking stresses.

It is well known that the progress of crystallization during high-speed spinning is usually dependent on the rapidity of spinning operations and a sudden increase in the crystallization rate in the neighborhood of 4,000 m/min has been reported as described, for example, in *Sen-i Kikai Gakkaishi* (Journal of the Textile Machinery Society of Japan), Vol. 38, p. 268 (1985). As for the effects of air drag on the progress of crystallization, the relationship between the tension during spinning and the distance of fiber travel (i.e., the distance between the spinneret and the convergence point as defined in accordance with the present invention) and part of the relevant physical data have been reported in the proceedings of the 10*th Joint Conference of Textile Societies in Japan* (Oct. 11-12, 1984) on pages 84 and 85. According to this reference, the fiber forms an amorphous structure as it travels an increased distance, but the reference does not have any description of a heat treatment to be conducted in subsequent stage and it remains entirely unknown what changes will occur in the fiber structure or its strength and elongation characteristics as a result of heat treatment. As is shown later in this specification, ease of handling during spinning is not attainable f the spinning speed becomes higher than 6,000 m/min, and at a speed of 4,000 m/min the strength and elongation properties of the fiber taken up show so much deterioration that no significant improvement will be achieved even if the fiber is subjected to subsequent heat treatment.

SUMMARY OF THE INVENTION

An object therefore, of the present invention is to provide a polyester fiber that is produced by high-speed spinning and which yet features the following advantages: it possesses strength and elongation characteristics that are comparable to those of drawn fibers which are produced by the traditional two-step spin-windup-draw process; it has good dye absorption; it experiences less variation in thermal shrinking stress under varying temperature conditions and hence is resistant to the occurrence of unevenness of yarn due to thermal shrinking stresses that will be introduced in heat treatments during subsequent processing such as crimping; it has relaxed orientation in the amorphous portion so that it exhibits improved processability and allows for better creping on hard twist yarns.

Another object of the present invention is to provide a process for producing such improved polyester fiber.

The polyester fiber of the present invention is produced by high-speed spinning and is characterized by filament fineness of from 1 to 3 d, a strength of at least 4.0 g/d, an elongation of up to 40%, a crystallinity ($X\rho$) of from 40 to 55%, a birefringence of from $140\times10^{-3}$ to $165\times10^{-3}$, an orientation function of from 0.36 to 0.45 in the amorphous portion, and a thermal shrinking stress that satisfies the following relations:

$$1.1 \leqq ST_{200}/ST_{100} \leqq 2.0 \quad \text{(I)}$$

$$50 \leqq ST_{max} \leqq 180 \quad \text{(II)}$$

where $ST_{100}$ is the shrinking stress (mg/d) at 100° C., $ST_{200}$ is the shrinking stress (mg/d) at 200° C., and $ST_{max}$ is a peak stress (mg/d) on a thermal shrinking stress curve.

The polyester fiber of the present invention may be produced by two process embodiments.

One process embodiment comprises taking up a melt-spun fiber in the absence of heat under the condition that satisfies the following relations (III) to (VI), continuously drawing the fiber under conditions that satisfy the following relation (VII), subsequently heat-treating the drawn fiber for a period of from 0.01 to 0.05 seconds with a heating roller at from 160° to 220° C., and thereafter winding up the heated fiber.

$$5{,}000-100\times(D+3) \leqq SS \leqq 5{,}000-100\times(D-1) \quad \text{(III)}$$

$$0.06 \leqq L/SS\cdot\sqrt{\ } \leqq 0.10 \quad \text{(IV)}$$

$$380 \leqq L \leqq 700 \quad \text{(V)}$$

$$0.8 \leqq To \leqq 1.2 \quad \text{(VI)}$$

$$1.0+(D-1)/20 \leqq \mathbf{DR} \leqq 1.0+D/10 \quad \text{(VII)}$$

where SS (spinning speed) is the speed (m/min) of a take up roller, L is the distance (cm) between the spinneret and the convergence point, To is the spinning tension (g/d) on the yarn immediately after the convergence point, DR is the draw ratio, and D is the filament fineness (d) of the fiber wound and is within the range of from 1 to 3 d.

The second process embodiment of the present invention comprises taking up a melt-spun fiber in the absence of heat at a speed of from 5,000 to 6,000 m/min under conditions that satisfy the following relations (IX) and (X), subsequently heat-treating the fiber for a period of from 0.01 to 0.05 seconds with a heating roller at from 160° to 220° C., with no drawing step being provided between the taken up and heat treatment steps, and finally winding up the heated fiber:

$$0.04 \leqq L/SS \cdot D \leqq 0.08 \quad \text{(IX)}$$

$$1.0 \leqq To \leqq 1.5 \quad \text{(X)}.$$

DETAILED DESCRIPTION OF THE INVENTION

The polyester used in the present invention is substantially composed of polyethylene terephthalate, optionally containing minor portions of comonomers such as polyethylene glycol and 5-Na-sulfo isophthalic acid, and can be prepared by any known methods of polymerization. It may also contain conventional additives such as delusterants, colorants, stabilizers, and antistats. The degree of polymerization of the polyester is also unlimited so long as its fiber-forming property is not impaired.

The first feature that characterizes the polyester fiber of the present invention is its strength and elongation properties that are comparable to those of drawn fibers produced by the traditional two-step spin-windup-draw process; it has a strength of at least 4.0 g/d, preferably at least 4.2 g/d, and a elongation of no more than 40%, preferably no more than 35%. present invention has strength and elongation characteristics comparable to those of the drawn fiber and can be immediately put to commercial use without being drawn after windup. If the strength of the polyester fiber is less than 4.0 g/d, it is too weak to prevent filament or yarn breaking. If the elongation of the polyester fiber exceeds 40%, its dimensional stability is reduced.

In the second aspect, the polyester fiber of the present invention has a crystallinity ($X\rho$) of from 40 to 55% as measured by densitometry, a birefringence of from $140\times10^{-3}$ to $165\times10^{-3}$, preferably from $145\times10^{-3}$ to $160\times10^{-3}$, and an orientation function of from 0.36 to 0.45 in the amorphous portion. As manifested by these numeric data, the polyester fiber of the present invention has high degrees of crystallinity and orientation and yet has relaxed orientation in the amorphous portion. If the degree of crystallinity is less than 40%, the fiber is insufficiently crystalline to exhibit dimensional stability under exposure to heat. If the degree of crystallinity exceeds 55%, the fiber becomes excessively crystalline to make efficient dye absorption difficult to achieve although this is favorable for the purpose of attaining good thermal stability. If the birefringence of the polyester fiber is lower than $140\times10^{-1}$, the fiber strength is unsatisfactory. If the birefringence exceeds $165\times10^{-3}$, the degree of orientation in the amorphous portion increases to impair the dyeability of the fiber. The orientation function in the amorphous portion must be within the range of from 0.36 to 0.45. If the orientation function in the amorphous portion is less than 0.36, the sufficient strength. If the orientation function exceeds 0.45, the fiber becomes somewhat taut and will develop too great a thermal shrinking stress to ensure high dimensional stability. If the orientation function in the amorphous portion is within the range of from 0.36 to 0.45, the fiber has very good processability and in the manufacture of a hard twist woven fabric the latent torque at the interlacing points of warp and filling yarns can be developed to a value close to its maximum limit and desired crepes can be imparted to the fabric. In order to achieve torque development for creping, the fabric is heat-treated in a relaxed state. This heat treatment on a relaxed fabric is intended to provide for easy development of the latent torque by means of facilitating the release of strains from the molecular chains of the fiber and the orientation function in the molecules of amorphous chains plays an important role in crepe properties. If the orientation function in the amorphous portion exceeds 0.45, not only is the dimensional stability of the fiber decreased but also the fiber becomes highly taut in the amorphous portion to reduce the efficiency of torque development.

The orientation function in the amorphous portion also has a significant effect on the dye absorption of the fiber. It is generally held that dyes are dispersed in the amorphous portion of a polyester fiber which is hydrophobic. Therefore, if the amorphous portion of a polyester fiber is highly oriented, dye dispersibility and hence the dye absorption of the fiber is reduced. If the orientation function in the amorphous portion is within the range of from 0.36 to 0.45, it is sufficiently relaxed to ensure good dye absorption by the fiber.

The polyester fiber of the present invention is also required to satisfy the following conditions (I) and (II) with respect to thermal shrinking stress, i.e., $$1.1 \leqq ST_{200}/ST_{100} \leqq 2.0 \quad \text{(I)}$$

$$50 \text{ mg/d} \leqq ST_{max} 180 \text{ mg/d} \quad \text{(II)}$$

where $ST_{100}$ and $ST_{200}$ signify the shrinking stresses (mg/d) at 100° C. and 200° C., respectively, and $ST_{max}$ is a peak stress (mg/d) on a thermal shrinking stress curve.

In other words, the polyester fiber of the present invention has a very small variation in thermal shrinking stress under varying temperature conditions as compared with the drawn fiber produced by the conventional two-step spin-windup-draw process, and, in addition, the absolute values of the thermal shrinking stress on the fiber itself are within a relatively small fixed range. The polyester fiber of the present invention has an $ST_{200}/ST_{100}$ ratio of from 1.1 to 2.0, preferably from 1.3 to 1.9, and an $ST_{max}$ of from 50 to 180 mg/d, preferably from 70 to 140 mg/d. Having these thermal shrinking stress characteristics, the polyester fiber of the present invention experiences less variation in the tension on yarn under varying temperature conditions that will occur during heat treatments such as the one employed in false-twist crimping operations and, as a result, the fiber can be processed into a yarn that is free from any unevenness in such aspects as crimping, diameter, and dye absorption that would otherwise occur on account of variation in tension. In addition, the yarn retains high heat setting properties and can be provided with desired crimps.

A probable reason why the fiber that satisfies the conditions (I) and (II) in terms of thermal shrinking stress cannot only be heat-treated in subsequent processing without causing any unevenness in yarn, but also can be provided with desirable crimping, appears to be as follows. For instance, if the yarn is subjected to false twist crimping in subsequent processing, it is generally heat-set at from 160° to 220° C., but the yarn passing through the false-twist crimping zone will not immediately reach a preset temperature and will instead increase in temperature gradually from room temperature to the preset temperature. If $ST_{100}$ is greater than $ST_{200}$, the yarn will shrink before the preset temperature is reached, allowing crimps on the yarn to be set only insufficiently. During false twisting, the yarn is usually placed under a tension of about 0.2 g/d, so if there is a great difference between $ST_{100}$ in the neighborhood of the glass transition point and $ST_{200}$ in the neighborhood of the heat-setting temperature, a great variation in tension will occur as the yarn temperature increases, thereby causing unevenness of yarn properties in various aspects. On the other hand, if $ST_{200}/ST_{100}$ is within the range of from 1.1 to 2.0, the variation in thermal shrinking stress under varying temperature conditions is small enough to minimize the variation in tension on the yarn such as to prevent the occurrence of unevenness of yarn. If $ST_{max}$, or a peak stress on the thermal shrinking stress curve, exceeds 180 mg/d in spite of $ST_{200}/ST_{100}$ satisfying the relation (I), the absolute value of thermal shrinking stress itself is too great to avoid the occurrence of unevenness of yarn on account of the variation in tension that is introduced during subsequent processing. If, on the other hand, $ST_{max}$ is less than 50 mg/d, the absolute value of thermal shrinking stress becomes so small that the heat settability of the yarn is reduced to render it difficult to produce desired crimps as a result of crimping. If $ST_{max}$ is within the range of from 50 to 180 mg/d, heat treatment in subsequent processing can be accomplished without causing any unevenness of yarn, and in addition, the heat settability of the yarn will not be impaired.

The polyester fiber of the present invention has a filament fineness of from 1.0 to 3.0 d, preferably from 1.5 to 2.5 d. If the filament fineness of the polyester fiber is smaller than 1.0 d, the fiber being produced is subjected to excessive tension and many broken filaments will occur. If the filament fineness is greater than 3.0 d, the formation and development of crystals will occur in the fiber as the yarn is taken up and only insufficient crystallization will be realized even if the fiber is subjected to heat treatment. The total fineness of the filaments in fiber yarn is preferably within the range of from 20 to 200 d.

A fabric that is stiff and has an improved dimensional stability can be produced from the polyester fiber of the present invention if it has an initial Young's modulus of from 80 to 110 g/d and a boil-off shrinkage of no more than 4%.

In the first and second process embodiments of the present invention as described hereinbefore, it is of extreme importance that the following two requirements be met: (1) when a melt-spun polyester fiber is cooled and taken up by a take up roller, the distance between the spinneret and the convergence point, the tension on the fiber, and the speed of the take up roller are adjusted such that the spun fiber is subjected to limited crystallization but enhanced orientation at a stage prior to contact with the take up roller to thereby produce a fiber that has a low degree of crystallinity but which is highly oriented; and (2) the fiber is then subjected to heat treatment to cause rapid crystallization therein. In other words, the stage up to the time when the spun fiber contacts the take up roller or when it is fed to the heating roller will bear great importance on the physical properties of the finally obtained polyester fiber. If the speed of the take up roller is less than 5,000 m/min as in the first process of the present invention, the spinning tension is insufficient to attain a highly oriented fiber on the take up roller and subsequent drawing is necessary. On the other hand, if the speed of the take up roller is 5,000 m/min or higher as in the second process of the present invention, the air drag will produce a sufficient tension on the travelling yarn to eliminate the need for subsequent drawing.

Therefore, in the first process embodiment where the spinning speed is less than 5,000 m/min, if the fiber is taken up with the takep up roller being set to a speed that satisfies the relation (III), the distance between the spinneret and the convergence point and the tension on the fiber are set to the values that satisfy the relations (IV) to (VI). For instance, if one wants to produce a fiber having a filament fineness of 2 d, he may take up the melt-spun fiber at a spinning speed (SS) within the range of from 4,500 to 4,900 m/min; if SS is 4,500 m/min, the filaments are converged with the distance (L) between the spinneret and the convergence point being set to a value of from 380 to 640 cm, and if SS is 4,900 m/min, L is set to a value of from 410 to 690 cm. In either case, the tension on the fiber is set to be within the range of from 0.8 to 1.2 g/d, preferably between 0.8 and 1.0 g/d. If these requirements are met, the fiber on the take up roller is highly oriented and yet has a low degree of crystallinity in spite of it having been spun at high speed. If, during fiber take up, SS exceeds its upper limit defined by formula (III), or if L exceeds 700 cm, or if the tension on the fiber exceeds 1.2 g/d, or if $L/SS\cdot\sqrt{D}$ exceeds the upper limit defined by formula (IV), the chance of filament breaking is increased, causing inconvenience in practical operations. If, on the other hand, SS during fiber take up is smaller than its lower limit defined by formula (III), or if L is less than 380 cm, or if the tension on the fiber is less than 0.8 g/d, or if $L/SS\cdot\sqrt{D}$ is smaller than the lower limit defined by formula (IV), the resulting fiber will have a high degree of crystallinity but reduced orientation, or a fiber that is low in both crystallinity and orientation will result.

In the first process of the present invention, the drawing step must be fed with a fiber that is highly oriented and has a low degree of crystallinity. It is therefore important that the melt-spun fiber be taken up with an unheated roller; if the fiber is taken up with a roller that has been heated to the glass transition temperature or higher, crystallization will proceed in the fiber to an undesirably great extent. In the first process of the present invention wherein the melt-spun fiber is taken up in the absence of heat, the fiber has only to be lapped over the take up roller by half a turn, and this permits a plurality of yarns to be spun simultaneously at a reduced energy cost. In addition, the fiber on the take up roller is highly oriented and has a low degree of crystallinity, so that it can be subjected to a cold-drawing step.

The polyester fiber which has been taken up under the conditions described above is subsequently drawn in the absence of heat at a draw ratio (DR) that satisfies formula (VII), and preferably satisfies formula (VIII), i.e., $$1.0+(D-1)/20 \leqq DR \leqq 1.0+D/15 \qquad \text{(VIII)}.$$

If the filament fineness is 2 d, the DR that satisfies formula (VII), and preferably formula (VIII), should be as low as from 1.05 to 1.20, and preferably from 1.05 to 1.13, to draw the fiber without letting any filament to break. If DR is smaller than the lower limit defined by formula (VII), the molecular chains in the oriented fiber are relaxed to yield a fiber that has only insufficient strength and elongation properties. If DR exceeds the upper limit defined by formula (VII), filament breaking will occur during fiber drawing.

If the second process of the present invention wherein the speed of take up roller is 5,000 m/min or higher, the spun fiber must be taken up under the condition that satisfies formulas (IX) and (X). For instance, if a fiber having a filament fineness of 2 d is taken up at a spinning speed (SS) of 5,000 m/min, the distance (L) between the spinneret and the convergence point may be set to a value within the range of from 400 to 800 cm, and preferably from 450 to 600 cm; if SS is 5,500 m/min, L may be set to a value between 440 and 880 cm, preferably between 450 and 600 cm. If L is smaller than either of the lower limits specified above, the fiber will undergo enhanced crystallization while becoming insufficiently oriented. If L is greater than either of the upper limits specified above, increased air drag will cause frequent filament breaking and present inconvenience for practical operations. The tension (To) on the fiber must be within the range of from 1.0 to 1.5 g/d, and preferably is from 1.1 to 1.5 g/d. If To is less than 1.0 g/d, the formation and development of crystals will occur in the fiber even if L satisfies formula (IX); if To exceeds 1.5 g/d, many broken filaments will occur. The additional requirement that must be met in the second process of the present invention is that the spinning speed (SS) be within the range of from 5,000 to 6,000 m/min, preferably from 5,000 to 5,700 m/min. If SS is less than 5,000 m/min, the resulting fiber will have a high degree of crystallinity but reduced orientation, or, alternatively, a fiber that is low in both crystallinity and orientation will result. If SS exceeds 6,000 m/min, increased tension on the fiber will cause frequent filament breaking and present inconvenience for practical operations.

In the present invention, the polyester fiber which has been drawn out (i.e., in the first process) or which has been taken up at from 5,000 to 6,000 m/min without drawing (i.e., in the second process) must be subsequently heat-treated. Drawing is effected in the first process in the absence of heat, so that the drawn fiber is not highly crystalline although it is highly oriented and this is also true for the fiber that has been simply taken up without drawing in the second process. Therefore, the fiber is subsequently heat-treated in order to cause further crystallization for developing improved strength. The fiber, if not subjected to heat treatment, has a low degree of crystallinity and hence a low strength level. In addition, the untreated fiber will become brittle when it is subjected to subsequent processing, say, alkali treatment for achieving loss in fiber weight.

The heat treatment under discussion is effected for the purpose of crystallizing the fiber; to this end, the fiber, either under tension (in the first process embodiment) or with its length held constant (in the second process embodiment), is heat-treated at from 160° to 220° C., preferably between 180° and 210° C., for a period of from 0.01 to 0.05 seconds, preferably from 0.01 to 0.03 seconds. If the temperature for heat treatment is lower than 160° C., the fiber is insufficiently crystallized to develop satisfactory strength and elongation characteristics. If the temperature is higher than 220° C., the fiber will either melt or break. If the duration of heat treatment is shorter than 0.01 second, uniform treatment is not attainable even if high temperatures are employed, and unevenness of the yarn will result. If thermal treatment is continued longer than 0.05 seconds, thermal shrinking stress characteristics and other features inherent in the polyester fiber to be produced by the present invention will be completely lost.

In the present invention, heat treatment is conducted with a heating roller which may be a heated roller, as shown in FIG. 4, or may take the form of a roller system wherein a saddle-shaped heater is disposed between a roller and a separate roller to heat the fiber lapped onto the saddle.

In the first process of the present invention, a three-roller system consisting of a take up roller, a drawing roller and a heating roller may be employed to continuously draw and heat-treat the fiber supplied from the take up roller. However, as in the second process involving no drawing step and in order to reduce the number of rollers used, a two-roller system consisting of a take up roller and a draw/heat roller which serves both as a drawing and a heating roller is preferably employed.

The polyester fiber of the present invention is prepared by either the first or second process described above. The spinning step of either process has the following characteristics. As already reported in the literature, spinning of a polyester at a high speed of at least 4,500 m/min, specifically at least 5,000 m/min causes "necking" at a point which slightly varies between 100 and 200 cm below the spinneret depending upon the filament fineness or the cooling conditions used as described, for example, in *Sen-i Kogaku* (Textile Engineering), Vol. 38, p. 243 (1985). It is generally held that this necking deformation occurs before enhanced molecular orientation and crystallization appears. Therefore, if the spinning speed exceeds 4,500 m/min in high-speed spinning, a sudden increase in the degree of fiber crystallinity will occur. However, in accordance with the first or second process embodiments of the present invention for producing a polyester fiber, no necking is found to occur even if the spinning speed is increased up to 5,500 m/min. This is probably because an extremely high tension is applied on the fiber during spinning and prevents the occurrence of necking deformation. In order to produce the polyester fiber of the present invention, the fiber is subjected to heat treatment after it has been taken up, and, prior to this heat treatment, the fiber has a very low degree of crystallinity. This will be clear from the comparison of the following two measured values of boil-off shrinkage. A fiber that is prepared by the prior art high-speed spinning method with the windup speed being set to at least 4,500 m/min has a boil-off shrinkage of no more than 7%. However, a fiber that has been taken up under high spinning tension as in the present invention, for example, a fiber of 75 d/36 f that has been spun under a tension (To) of 1.4 g/d and taken up at a speed of 5,500 m/min has a much higher boil-off shrinkage (40.4%).

If the fiber having such a low degree of crystallinity is subsequently heat-treated, the orientation of the molecular chains in fiber that has progressed to a certain extent facilitates further crystallization so as to produce a polyester fiber that is not only highly crystalline and oriented but also has a large crystal size. Prior to heat treatment, the amorphous portion of the fiber is highly oriented, but upon heat treatment the fiber crystallizes and shrinks at the same time so as to produce a small orientation function in the amorphous portion.

The diameter of filaments, as a function of the distance from spinneret, in a polyester fiber yarn (75 d/36 f) which was spun with the speed of take up roller being set to 5,500 m/min; one being the case where the fiber was taken up under ordinary levels of spinning tension ranging from 0.4 to 0.5 g/d, and the other being the case where the fiber was taken up under a higher spinning tension (1.4 to 1.5 g/d) in accordance with the second process of the present invention. The fiber taken up at low tension had a necking point in the neighborhood of 40 cm below the spinneret and the fiber diameter decreased sharply at that point. On the other hand, the fiber taken up at a higher tension decreased in diameter only linearly.

Data of wide-angle X-ray scattering of various types of fiber in terms of diffraction patterns taken along the equator for (010), ($\bar{1}$10), and (100) plane normals in the increasing order of angles shows, the fiber of the present invention is highly crystalline.

One embodiment of the process of the present invention for producing a polyester fiber is hereinafter described. A polyester yarn Y is extruded through a spinneret that is held at a temperature of from 20° to 50° C. higher than the melting point (Tm) of the polyester. The extruded yarn is passed through heating tube that is situated immediately below the spinneret, and which is held at a temperature not lower than Tm. Thereafter, the yarn is cooled in a cooling device to solidify. The filaments in the solidified yarn are converged at a convergence device which is a lubricated slit apparatus that is positioned farther away from the spinneret than in the conventional case. The converged yarn is then guided onto a take up roller and drawn between that roller 4 and a heating roller in the first process of the present invention; in the second process, no such drawing is effected. Subsequent to the drawing step, or immediately after the take up step, the yarn is heat-treated on the roller to cause enhanced crystallization and is finally wound up on a bobbin.

In these processes, the convergence of filaments may be improved by means of interlacing without doing any harm to the purposes of the present invention.

The various parameters used to characterize the polyester fiber of the present invention and the process for producing it are to be measured by the following methods. The spinning tension, or the tension applied to the yarn that has just passed through the convergence point, is the value that is obtained by measuring the tension on the yarn 5 cm below the convergence point with a tension meter, Type R-1092 of Rothschild Corporation. The values of physical properties of the fiber are those measured after it was conditioned at 20° C. and 65% RH for 24 hours. Measurement of strength and elongation characteristics were conducted with Autograph DSS-500 of Shimadzu Corporation on a 30-cm long sample at a pulling rate of 30 cm/min. Birefringence measurement was conducted with a polarizing microscope equipped with a Berek compensator, using tricresyl phosphate as an immersion liquid. The degree of crystallinity (Xp) was calculated from the density data that was obtained with a gradient tube using n-heptane and tetrachloroethane at 20° C.; the following formula was used for calculation purposes:

$$X\rho = \frac{\rho - \rho_a}{\rho_c - \rho_a} \cdot \frac{\rho_c}{\rho}$$

where $\rho_a = 1.335$ g/cm$^3$ and $\rho_c = 1.455$ g/cm$^3$. Measurement of thermal shrinking stress was conducted with a thermal shrinking stress meter, KE-2 of Kanebo Engineering Co., Ltd., on a 16-cm long sample that was made into an 8-cm loop and heated at a rate of 100° C./min, with an initial load of 1/30 g/d being applied. The boil-off shrinkage was determined as follows: a yarn was made into a 50-cm loop and stressed under an initial load of 1/30 g/d for measurement of its length (X); then, the load was removed and the loop was immersed in boiling water for 15 minutes and air-dried; a load of 1/30 g/d was again applied on the loop and its length (Y) was measured; the difference between X and Y was divided by X to determine the boil-off shrinkage of the yarn.

The orientation function in the amorphous portion (fam) of the fiber was determined by the following formula:

$$\Delta N = Xc \cdot fc \cdot \Delta Nc + (1 - Xc) \cdot fam \cdot \Delta Nam$$

where ΔN is the birefringence of the fiber, Xc is the degree of crystallinity as measured by X-ray diffraction, fc and fam denote the orientation functions in the crystalline and amorphous portions, respectively, ΔNc and ΔNam signify the birefringences of the crystalline and amorphous portions, respectively, in a perfectly oriented state, with ΔNc and ΔNam having values of $220 \times 10^{-3}$ and $275 \times 10^{-3}$, respectively.

The orientation function in the crystalline portion (fc) was determined by wide-angle X-ray scattering diffraction in accordance with the following method: a combined filament sample (504,000 d) was set in an X-ray diffractiometer, Model RAD-RB of Rigaku Denki Co., Ltd., and measurement was conducted by the counter method with CuKα radiation that had been passed through a Ni filter. The crystal size of the fiber was calculated by the Scherrer formula based on the diffraction intensities of (010), (100), and ($\bar{1}$05) plane normals of polyester appearing along the equator and on the basis of the intensity for the amorphous portion as measured in the meridional direction. The degree of crystallinity (Xc) was determined by gravimetry with the diffraction intensity along the equator being corrected for aerial scattering. The orientation function of the crystalline portion (fc) was calculated by the following equations based on the curves plotting the intensity distribution of the azimuthal angles of (010) and (100) plane normals:

$$\overline{\cos^2\phi} = \overline{\sin^2\delta} = \frac{\int_0^{\pi/2} I(\delta)\sin^2\delta\cos\delta d\delta}{\int_0^{\pi/2} I(\delta)\cos\delta d\delta}$$

$$fc = 1 - \frac{3}{2} \cdot \mathrm{cosec}^2\alpha \left( \overline{\sin^2\delta_1} + \overline{\sin^2\delta_2} \right)$$

where $\phi$ is the angle between a given crystal axis "the (010) or (100) plane normal" and fiber axis, $\delta$ is the angle of deviation from the equatorial line, and $\delta_1$ and $\delta_2$ signify the deviations of (010) and (100) plane normals, and $\alpha$ denotes the angle formed between (010) and (100) plane normals and has a value of 59°24".

The long period spacing of the fiber crystal was determined by applying Bragg's law ($\lambda/2 \sin\phi$) to the results of small angle X-ray diffraction, using the equation $\tan 2\phi = a/l$, where is the distance between a photographic film and the sample, 2a is the maximum spacing symmetrical with respect to the equatorial plane, and $\lambda$ is the X-ray wavelength.

The relative viscosity, $\eta r$, of the polymer was measured in a 1/1 mixture of phenol and tetrachloroethane at 25° C. at a concentration of 0.5 g in 100 cc.

The following examples are provided for the purpose of further illustrating the present invention, but are in no way to be taken as limiting.

EXAMPLES

Samples of polyester fiber having a total fineness of 75 d were prepared by melt-spinning polyethylene terephthalate semi-dull chips ($\eta r = 1.38$) under the conditions shown in Table 1 in accordance with the process described hereinbefore. The chips had been melted at a constant temperature of 290° C.

The dash mark "—" in the column of "heat treatment with heating roller" denotes that the roller was unheated and set at room temperature. The duration of heat treatment was controlled by changing the number of turns by which the fiber was lapped around the roller. During spinning, the fiber was cooled with air (20° C.) being blown circumferentially at a position 10 cm below the heating tube (10 cm long) that was placed immediately below the spinneret and which was set to a temperature of 300° C.

TABLE 1

| Sample No. | Take Up Roller Speed (A) (m/min) | Heating Roller Speed (B) (m/min) | Winding Speed (m/min) | Draw Ratio (B)/(A) | Heat Treatment with Heating Roller Temp. (°C.) | Heat Treatment with Heating Roller Time (sec) | Convergence Point (cm) | Tension (To) (g/d) | Filament Fineness (d) | L/SS · √D or L/SS · D |
|---|---|---|---|---|---|---|---|---|---|---|
| 1 | 4,000 | 4,000 | 4000 | 1.00 | 190 | 0.05 | 450 | 0.5 | 2.1 | 0.077 |
| 2 | 4,500 | 4,500 | 4,500 | 1.00 | 190 | 0.05 | 450 | 0.6 | 2.1 | 0.069 |
| 3 | 4,700 | 4,700 | 4,700 | 1.00 | — | — | 200 | 0.4 | 2.1 | 0.029 |
| 4 | 4,700 | 5,500 | 5,500 | 1.20 | 190 | 0.05 | 200 | 0.4 | 2.1 | 0.029 |
| 5* | 4,700 | 5,500 | 5,500 | 1.20 | 190 | 0.05 | 450 | 0.8 | 2.1 | 0.066 |
| 6 | 5,000 | 5,300 | 5,300 | 1.06 | 190 | 0.05 | 450 | 1.1 | 2.1 | 0.062 |
| 7 | 5,300 | 5,300 | 5,300 | 1.00 | — | — | 200 | 0.5 | 2.1 | 0.026 |
| 8 | 5,300 | 5,300 | 5,300 | 1.00 | 190 | 0.05 | 200 | 0.5 | 2.1 | 0.026 |
| 9 | 5,300 | 5,300 | 5,300 | 1.00 | — | — | 500 | 1.3 | 2.1 | 0.065 |
| 10* | 5,300 | 5,300 | 5,300 | 1.00 | 190 | 0.05 | 500 | 1.3 | 2.1 | 0.065 |
| 11 | 5,300 | 5,300 | 5,300 | 1.00 | 190 | 0.10 | 500 | 1.3 | 2.1 | 0.065 |
| 12* | 5,300 | 5,300 | 5,300 | 1.00 | 190 | 0.05 | 500 | 1.4 | 1.6 | 0.075 |
| 13 | 6,200 | 6,200 | 6,200 | 1.00 | 190 | 0.05 | 500 | 1.6 | 2.1 | 0.056 |
| 14 | 2,050 | 5,050 | 5,050 | 2.46 | 190 | 0.05 | 200 | 0.2 | 2.1 | — |

(Notes)
1: Sample No. 14 was drawn after preliminary heating with the take up roller for 0.05 seconds at 100° C.
2: L/SS · √D and L/SS · D calculations were made by formula (IV) for sample Nos. 1 to 5 and by formula (IX) for sample Nos. 6 to 13, respectively.
3: *samples of the present invention The fiber samples thus prepared had the physical characteristics shown in Table 2. Sample No. 6 experienced occasional breaking of filaments between the take up and heating rolls, which was a great inconvenience to the spinning operation. Sample No. 9 was also defective in that the paper tube could not be removed the winder when more than 1 kg of the fiber was wound up. Sample No. 13 experienced breaking of filaments between the spinneret and take up roller, and Sample cannot be produced. Sample No. 15 was a drawn fiber (75 d/36 f) that was prepared by the two-step spin-and-draw process as follows: an undrawn yarn was taken up at a speed of 1,400 m/min, then drawn at a ratio of 3.1 while it was simultaneously heat-treated in the drawing zone at 150° C.

TABLE 2

| Sample No. | Strength (g/d) | Elongation (%) | Initial Young's Modulus (g/d) | Boil-off Shrinkage (%) | Binefringence ($\times 10^{-3}$) | Crystallinity ($X\rho$) (%) | Thermal Shrinking Stress $ST_{100}$ (mg/d) | Thermal Shrinking Stress $ST_{200}$ (mg/d) | Thermal Shrinking Stress $ST_{max}$ (mg/d) | Stress Ratio $ST_{200}/ST_{100}$ |
|---|---|---|---|---|---|---|---|---|---|---|
| 1 | 3.4 | 70.2 | 52.3 | 12.4 | 80 | 26.6 | 114 | 98 | 120 | 0.86 |
| 2 | 3.5 | 48.8 | 70.6 | 6.0 | 119 | 28.1 | 144 | 74 | 150 | 0.52 |
| 3 | 3.6 | 47.3 | 72.0 | 5.7 | 99 | 32.7 | 100 | 46 | 106 | 0.47 |
| 4 | 3.9 | 38.2 | 75.5 | 5.3 | 126 | 38.7 | 75 | 170 | 188 | 2.26 |
| 5* | 4.9 | 28.5 | 96.6 | 3.4 | 160 | 42.1 | 125 | 157 | 166 | 1.26 |
| 6 | 4.6 | 29.4 | 89.3 | 3.9 | 161 | 41.2 | 83 | 132 | 132 | 1.59 |
| 7 | 4.0 | 45.6 | 75.2 | 3.3 | 113 | 41.2 | 136 | 94 | 136 | 0.67 |
| 8 | 3.9 | 48.2 | 79.8 | 3.1 | 130 | 48.0 | 146 | 132 | 160 | 0.90 |
| 9 | 4.1 | 40.5 | 84.6 | 70.6 | 131 | 16.1 | 224 | 160 | 240 | 0.71 |
| 10* | 4.8 | 32.5 | 93.6 | 3.4 | 155 | 41.2 | 65 | 90 | 90 | 1.38 |
| 11 | 4.5 | 20.4 | 100.7 | 2.2 | 166 | 56.9 | 29 | 45 | 45 | 1.55 |
| 12* | 5.2 | 30.2 | 92.5 | 2.9 | 158 | 43.8 | 55 | 74 | 74 | 1.35 |
| 13 | — | — | — | — | — | — | — | — | — | — |
| 14 | 4.6 | 29.5 | 86.3 | 6.5 | 162 | 34.4 | 186 | 254 | 254 | 1.36 |
| 15 | 5.0 | 28.4 | 103.1 | 6.1 | 158 | 38.7 | 126 | 306 | 312 | 2.42 |

Note: *samples of the present invention

Selected fiber samples in Table 2 (Nos. 3, 4, 5, 9, 10, 11, 12, 14, and 15) were subjected to analysis of their microstructure by X-rays diffraction. The results are shown in Table 3.

TABLE 3

| Sample No. | Crystal Size (Å) (010) | (100) | (105) | Long-Period Spacing (Å) | fc for (010) Plane | Xc | fam |
|---|---|---|---|---|---|---|---|
| 3 | 40 | 40 | 56 | — | 0.92 | 35.7 | 0.151 |
| 4 | 48 | 36 | 71 | 141 | 0.94 | 39.4 | 0.267 |
| 5* | 37 | 28 | 72 | 135 | 0.91 | 49.0 | 0.441 |
| 9 | 23 | 23 | 41 | — | 0.90 | 18.3 | 0.422 |
| 10* | 47 | 37 | 70 | 165 | 0.93 | 51.8 | 0.370 |
| 11 | 46 | 35 | 72 | 120 | 0.92 | 59.6 | 0.408 |
| 12* | 43 | 37 | 77 | 155 | 0.94 | 52.3 | 0.380 |
| 14 | 26 | 23 | 63 | 132 | 0.89 | 38.3 | 0.389 |
| 15 | 33 | 27 | 57 | 136 | 0.91 | 40.5 | 0.470 |

Note: *samples of the present invention

As is clear from Table 2 and 3, the polyester fiber samples (Nos. 5, 10, and 12) prepared in accordance with the present invention were highly oriented and crystalline and yet their orientation function in the amorphous portion was lower than that of the drawn fiber (No. 15). In addition, the thermal shrinking stresses these three samples had low peak values and were stable under varying temperature conditions. Sample Nos. 2, 3, 4, 7, and 8 which were spun under low tensions that were normally used in conventional fiber spinning had low strength but high elongation characteristics. Sample Nos. 11 and 14 had strength and elongation characteristics that were within the scope of the present invention; however, sample No. 11 had received heat treatment for so long a period of time that its degree of crystallinity was excessively high, and, in addition, this sample had a low peak value of thermal shrinking stress, which indicates its low heat settability. On the other hand, sample No. 14 was less crystalline and exhibited certain strength and elongation levels but its thermal stability was relatively low.

Dye exhaustion by selected fiber samples was evaluated under the following conditions and the results are shown in Table 4. A one-gram portion of each fiber sample was dyed for 1 hour at 100° C. with a disperse dye, Teracil Navy Blue SGL (2% o.w.f.; bath to fiber ratio, 1) in the presence of 1 g/l of a dispersant, Disper TL, of ammonium sulfate and 0.1 cc/l of formic acid used as carriers. The dye concentration of the residual liquor was measured with a spectrophotometer and the difference in dye concentration between the dye stock solution and the residual liquor was measured to determine dye exhaustion by the fiber.

TABLE 4

| Sample No. | Dye Exhaustion (%) |
|---|---|
| 5* | 22.4 |
| 10* | 23.5 |
| 14 | 16.8 |
| 15 | 7.1 |

Note: *sample of the present invention

As is clear from Table 4, sample Nos. 5 and 10 which were prepared in accordance with the present invention had better dye absorption than the drawn fiber (sample No. 15) because they exhibited high values of dye exhaustion.

Woven fabrics were prepared from selected fiber samples, Nos. 5, 10, 14, and 15, by the following method. Fiber yarns were hard-twisted (both S and Z twists), with 2,500 twists being imparted per meter. Each of the S- and Z-hard-twisted yarns was treated with dry heat (85° C.) for 45 minutes so as to heat-set the developed torque temporarily. With the hard-twisted yarns being used as warp and filling yarns, a plain weave was produced by repeating two S-twists and two Z-twists alternately at a warp density of 108 ends per inch and a weft density of 90 picks per inch. The resulting gray fabric was immersed in hot water (100° C.) for 30 minutes under agitation to produce a crepe effect. The crepe yarn was then finished by an appropriate technique. The weaves produced from fiber sample Nos. 5 and 10 of the present invention were better in quality than the hard-twisted fabrics prepared from sample Nos. 14 and 15 since the former had very fine crepes and a softer hand.

Having the structure described above, the polyester fiber of the present invention exhibits strength and elongation characteristics that are comparable to those of drawn fibers prepared by the conventional two-step spin-windup-draw process in spite of the fact that it is produced by high-speed spinning. In addition, this polyester fiber has good dyeability and its thermal shrinking stress characteristics are less sensitive to temperature variations, so that the fiber can be subjected to subsequent processing such as crimping without experiencing any great unevenness of yarn due to varying thermal shrinking stress during heat treatment. As a further advantage, the orientation in the amorphous portion of the fiber is sufficiently relaxed to provide it with improved processability, and this permits a satisfactory crepe effect to be produced on hard-twist yarns.

In accordance with the first and second processes of the present invention, a polyester fiber having the characteristics described above can be readily produced by high-speed spinning.

While the invention has been described in detail and with reference to specific embodiments thereof, it will be apparent to one skilled in the art that various changes and modifications can be made therein without departing from the spirit and scope thereof.

What is claimed is:

1. A polyester fiber produced by high-speed spinning which is characterized by a filament fineness of from 1 to 3 d, a strength of at least 4.0 g/d, an elongation of up to 40%, a crystallinity ($X\rho$) of from 40 to 55%, a birefringence of from $140\times10^{-3}$ to $165\times10^{-3}$, an orientation function of from 0.36 to 0.45 in the amorphous portion, and a thermal shrinking stress that satisfies the relations $$1.1 \leqq ST_{200}/ST_{100} \leqq 2.0 \quad \text{(I)}$$

and $$50 \leqq ST_{max} \leqq 180 \quad \text{(II)},$$

where $ST_{100}$ is the shrinking stress (mg/d) at 100° C., $ST_{200}$ is the shrinking stress (mg/d) at 200° C., and $ST_{max}$ is a peak stress (mg/d) on a thermal shrinking stress curve.

2. A polyester fiber according to claim 1, wherein the strength is at least 4.2 g/d, the elongation is up to 35%, and the birefringence is from $145\times10^{-3}$ to $160\times10^{-3}$.

3. A polyester fiber according to claim 2, wherein the filament fineness is from 1.5 to 2.5 d.

4. A polyester fiber according to claim 1 which is further characterized by an initial Young's modulus of from 80 to 110 g/d and a boil-off shrinkage of no more than 4%.

* * * * *